United States Patent [19]

Kawaguchi et al.

[11] Patent Number: 4,618,134

[45] Date of Patent: Oct. 21, 1986

[54] AUTOMATIC PAPER SHEET SUPPLYING APPARATUS

[75] Inventors: Katsuhiko Kawaguchi; Yoshiaki Ono, both of Shizuoka, Japan

[73] Assignee: Tokyo Electric Co., Ltd., Tokyo, Japan

[21] Appl. No.: 704,867

[22] Filed: Feb. 25, 1985

[30] Foreign Application Priority Data

Feb. 29, 1984 [JP] Japan ..... 59-37589
Mar. 12, 1984 [JP] Japan ..... 59-46876

[51] Int. Cl.[4] ..... B65H 5/00; B65H 29/60

[52] U.S. Cl. ..... 271/4; 271/9; 271/303; 400/625

[58] Field of Search ..... 271/4, 9, 303, 305, 271/297, 209, 198, 240, 257, 288, 289, 290; 400/625, 629, 605

[56] References Cited

U.S. PATENT DOCUMENTS

| | | | |
|---|---|---|---|
| 3,430,748 | 3/1969 | Parri | 400/625 |
| 3,598,396 | 8/1971 | Andrews et al. | 271/9 |
| 3,753,483 | 8/1973 | Lundquist | 400/605 X |
| 4,084,805 | 4/1978 | Simpson | 271/303 X |
| 4,161,312 | 7/1979 | Eckhardt et al. | 271/303 X |
| 4,220,323 | 9/1980 | Smith | 271/207 X |
| 4,268,021 | 5/1981 | Rutishauser et al. | 271/4 |
| 4,275,969 | 6/1981 | Matsuhisa et al. | 400/625 |

FOREIGN PATENT DOCUMENTS

| | | | |
|---|---|---|---|
| 0054327 | 6/1982 | European Pat. Off. | 400/625 |
| 58-53644 | 4/1983 | Japan . | |
| 58-32937 | 7/1983 | Japan . | |

*Primary Examiner*—Bruce H. Stoner, Jr.
*Assistant Examiner*—Lawrence J. Goffney, Jr.
*Attorney, Agent, or Firm*—Frishauf, Holtz, Goodman & Woodward

[57] ABSTRACT

An automatic paper sheet supplying apparatus for supplying paper sheets one after another, via a first guide surface of a first stationary guide which extends into a paper sheet processer with which the supplying apparatus is combined. The sheets are fed from a sheet holding unit to the processor. A processed paper sheet is led via a passage between the second guide surface of the first guide and a second stationary guide, from the processor to a stacking unit. A movable guide is capable of moving between an open position, at which the entrance of the stacking unit is not covered so as to allow the entering of the processed sheet to the stacking unit, and a closed position, at which the entrance of the stacking unit is covered so as to disturb the processed sheet from entering the stacking unit. When the movable guide is in the closed position, it is possible to manually feed a separate paper sheet to the processor via the passage between the first and second stationary guides and manually receive the processed sheet coming from the passage.

15 Claims, 8 Drawing Figures

AUTOMATIC PAPER SHEET SUPPLYING APPARATUS

BACKGROUND OF THE INVENTION

This invention relates to an automatic paper sheet supplying apparatus which is used in combination with a paper sheet processing apparatus, and particularly relates to the automatic paper sheet supplying apparatus which can not only automatically supply sheets of paper to the processing apparatus but can also manually supply sheets of paper to the processing apparatus. The processing apparatus has a sheet passage opening provided in a housing, paper sheet processing means for processing sheets of paper and paper sheet guide means for guiding a paper sheet coming from the sheet passage opening to the paper sheet processing means and guiding a processed paper sheet coming from the paper sheet processing means to the sheet passage opening.

Heretofore, in the automatic paper sheet supplying operation by an automatic paper sheet supplying apparatus, paper sheets held in paper sheet holding means are automatically supplied one after another to a paper sheet processing apparatus and processed paper sheets discharged from a paper sheet passage opening are automatically stacked in stacker means.

In the conventional, manual paper sheet supplying operation, on the other hand, a separate paper sheet which is not held in the paper sheet holding means is supplied, by hand, to the sheet passage opening of the paper sheet processing apparatus, not by way of paper sheet holding means and a processed paper sheet discharged from the sheet passage is received by hand, not by way of stacker means.

The automatic paper sheet supplying apparatus of the type noted above is well known in the art, for instance as disclosed in Japanese Utility Model Application Disclosure No. 56-53644 and Japanese Utility Model Publication No. 58-32937. In the automatic paper sheet supplying apparatus disclosed in the Japanese Utility Model Application Disclosure No. 58-53644 noted above, it is necessary, when changing an automatic paper sheet supplying operation over to a manual one, to remove all the processed paper sheets from the stacker means and then rotate the entire stacker means. When the stacker means is rotated, it is altered from a closed position, at which the sheet passage opening is covered, to an open position, at which the sheet passage opening is not covered. With the stacker means in the open position, paper sheets can be manually inserted into the sheet passage opening and also processed paper sheets discharged from the sheet passage opening can be manually received.

The stacker means, however, does not only have a high rigidity structure for holding a plurality of processed sheets but also has guide rollers and guide members for guiding the processed sheets, so that it is comparatively heavy in weight. Therefore, it is necessary to apply a comparatively large force to move the stacker means between the open position and closed position. In addition, when changing the automatic paper sheet supplying operation over to the manual one, the processed paper sheets have to be removed from the stacker means in advance. Therefore, switching the paper sheet supplying operation from an automatic to a manual mode requires a lot of effort and the operation of removing the plurality of paper sheets is rather cumbersome to the user.

In the automatic paper sheet supplying apparatus disclosed in the Japanese Utility Model Publication No. 58-32937, when changing the automatic paper sheet supplying operation over to the manual one, a part of a guide member, which leads processed paper sheets discharged from a sheet passage opening to stacker means, is opened to make an opening and paper sheets are manually inserted into the sheet passage opening through the opening noted above and processed sheets discharged from the sheet passage opening are manually received through the opening.

In this apparatus, however, a part of the sheet guide means of the paper sheet processing apparatus projects through the sheet passage opening to the outside of the paper sheet processing apparatus, and the end of the projecting part of the sheet guide means reaches the afore-mentioned opening formed in the guide member of the automatic paper sheet supplying apparatus.

Therefore, when paper sheets are manually inserted into the sheet passage opening through the opening noted above, it is liable to erroneously insert a paper sheet not to the inlet side of the sheet guide means but to the outlet side thereof. Erroneous insertion of paper sheets will cause trouble in the paper sheet processing apparatus.

SUMMARY OF THE INVENTION

An object of the invention is to provide an automatic paper sheet supplying apparatus, which permits the automatic paper sheet supplying operation to be easily changed over to a manual one, and is free from the possibility of erroneous insertion of paper sheet in the manual paper sheet supplying operation and is simple in construction.

To attain the above object of the invention, there is provided an automatic paper sheet supplying apparatus to be used in combination with a paper sheet processing apparatus having a sheet passage opening provided in a housing, paper sheet processing means for processing paper sheet and paper sheet guide means for guiding a paper sheet coming from the sheet passage opening and also guiding a processed paper sheet coming from the paper sheet processing means to the sheet passage opening, comprising:

sheet holding means for holding a plurality of paper sheets and feeding out the plurality of paper sheets one after another;

a first stationary guide member with an end portion extending into the sheet passage opening of the paper sheet processing apparatus, said first stationary guide member having a first guide surface for guiding a paper sheet coming from the holding means to the sheet guide means of the paper sheet processing apparatus and a second guide surface for guiding a processed paper sheet from the paper sheet guide means through the sheet passage opening to be discharged to the outside of the paper sheet processing apparatus and also guiding a paper sheet, which is separate from the plurality of paper sheets held in the sheet holding means and is inserted into the sheet passage opening from the outside of the paper sheet processing apparatus to the sheet guide means to let the separate paper sheet be guided by the sheet guide means to the paper sheet processing means;

a second stationary guide member provided to face the second guide surface of the first stationary guide member and guiding, in co-operation with the second guide surface of the first stationary guide member, a processed paper sheet discharged from the sheet passage opening and the separate paper sheet inserted into the sheet passage opening;

an exit provided on the extension of the second guide surface of the first stationary guide member and discharging a processed paper sheet into an outer space;

a movable guide member provided adjacent to the inlet side of the exit and movble between an open position, at which the exit is open, and a closed position, at which the exit is closed, the movable guide member, when it is in the open position, being located on the extension of the secondary stationary guide, to guide a processed paper sheet discharged through the sheet passage opening and coming through between the second guide surface of the first stationary guide member and the second stationary guide member to the exit, the movable guide member, when it is in the closed position, being located on the extension of the second guide surface of the first stationary guide member to guide the processed paper sheet coming through between the second guide surface of the first stationary guide member and the second stationary guide member to the outside and also guide the separate paper sheet from the outside into the space between the second guide surface of the first stationary guide member and the second stationary guide member; and switch operation means for switching the movable guide member between the open position and closed position.

According to the invention, it is possible to change an automatic paper sheet supplying operation to a manual one by merely switching the movable guide member from the open position to the closed position. More specifically, there is no need to remove the processed sheets discharged from the exit before the switching operation. In addition, the movable guide member that fullfils the function noted above is far simpler in construction and far lighter in weight than the prior art movable stacker means, so that the switching of operations can be easily achieved.

Also, according to the invention the first stationary guide member is inserted into the sheet passage opening, and an opening, through which a paper sheet is manually supplied to the sheet passage opening, is restricted to a single guide passage which is defined between the second guide surface of the first stationary guide member and the second stationary guide member. Therefore, there is no possibility of the erroneous insertion of a paper sheet in the manual paper sheet supplying operation.

In the automatic paper sheet supplying apparatus of the above construction according to the invention it is preferable that the movable guide member extends flush with the second guide surface of the first stationary guide member without making any step therebetween when in the closed position.

Such a structure greatly reduces the possibility of paper sheets jamming in the manual paper sheet supplying operation.

Further, in the automatic paper sheet supplying apparatus according to the invention it is preferable that the movable guide member has a plate-like shape spreading out substantially in the plane of a paper sheet moving between the second stationary guide member and the second guide surface of the first stationary guide member, and the switch operation means includes a elongated member provided at least at either side end of the movable guide member in a direction thereof perpendicular to the direction of progress of the paper sheet, the elongated member being rotatable in an imaginary plane which intersect the plane of the movable guide member between a first position, at which the elongated member crosses the plane of the movable guide member, and one end thereof is in contact with a circumferential area of the exit to hold the movable guide member in the open position, and a second position, at which the elongated member extends substantially parallel to the plane of the movable guide member and one end thereof is spaced apart from the circumferential area of the exit to allow the location of the movable guide member in the closed position.

With this arrangement, it is possible to simplify the construction of the movable guide member and switch operation means and reduce the cost of manufacture.

Further, in the automatic paper sheet supplying apparatus according to the invention it is preferable that the switch operation means includes biasing means for biasing the movable guide member to the closed position.

This arrangement permits the reliable switching of the movable guide member from the open position to the closed position, and vice versa.

Further, in the automatic paper sheet supplying apparatus according to the invention the switch operation means may include another elongated member provided at the other side end of the movable guide member, the distance between one ends of the two elongated members being set so as to restrict the movement of a processed paper sheet, that comes from the sheet passage opening between the second guide surface of the first stationary guide member and the second stationary guide member in order that the processed sheet be discharged to the outside space through the exit, in directions substantially perpendicular to the direction of progress of the processed paper sheet.

Further, the automatic paper sheet supplying apparatus according to the invention may further comprise stacker means for holding a plurality of processed paper sheets coming from the exit in a stacked form.

The stacker means facilitates the arrangement and transport of these processed paper sheets.

Further, in the automatic paper sheet supplying apparatus the stacker means includes a main feed-in roller provided at the exit and a plurality of auxiliary feed-in rollers spaced apart along and in contact with the outer periphery of the main feed-in roller so as to clamp, in co-operation with the main feed-in roller, a processed paper sheet having been led to the exit by the movable guide member and move it into the stacker means.

With this arrangement, processed paper sheets coming from the exit can be reliably led into the stacker means without slip and at a constant speed, so that a plurality of processed sheets can be held in the stacker means in a neatly stacked state. Besides, the frictional force applied to the processed paper sheet between each of the plurality of auxiliary feed-in rollers and the main feed-in roller, for the movement of the processed sheet, may be low for each auxiliary feed-in roller, so there is no possibility that the processed paper sheet will be deformed by the frictional force.

Further, in the automatic paper sheet supplying apparatus according to the invention at least one of the main feed-in roller and the plurality of feed-in rollers may be made of a conductive material and grounded for removing static electricity from a processed paper sheet clamped between the main feed-in roller and the auxiliary feed-in rollers.

With this arrangement, there is no possibility that the plurality of processed paper sheets will be irregularly stacked in the stacker means due to static electricity.

In order for the processed paper sheets from the exit to be neatly stacked in the stacker means at a constant speed and also to prevent deformation of the processed sheets due to frictional forces applied thereto, the stacker means may include a main feed-in roller provided at the exit, a pair of auxiliary feed-in rollers disposed in the neighborhood of the outer periphery of the main feed-in roller and spaced apart along the outer periphery of the main feed-in roller, and an endless belt passed round the pair of auxiliary feed-in rollers and in contact with the outer periphery of the main feed-in roller between the pair of auxiliary feed-in rollers to clamp, in co-operation with the main feed-in roller, a processed paper sheet having been led to the exit by the movable guide member and move it into the stacker means.

Even in this case, at least one of the main feed-in roller and endless belt may be made of a conductive material and earthed to remove static electricity from the processed paper sheet clamped by the main feed-in roller and a plurality of conductive rollers, thus eliminating the possibility of a plurality of processed paper sheets being stacked irregularly in stacker means due to static electricity thereon.

Now, an embodiment of the automatic paper sheet supplying apparatus according to the invention and two modifications thereof will be described with reference to the drawings.

DETAILED DESCRIPTION OF THE PREFERRED EMBODIMENT

Figure 1:
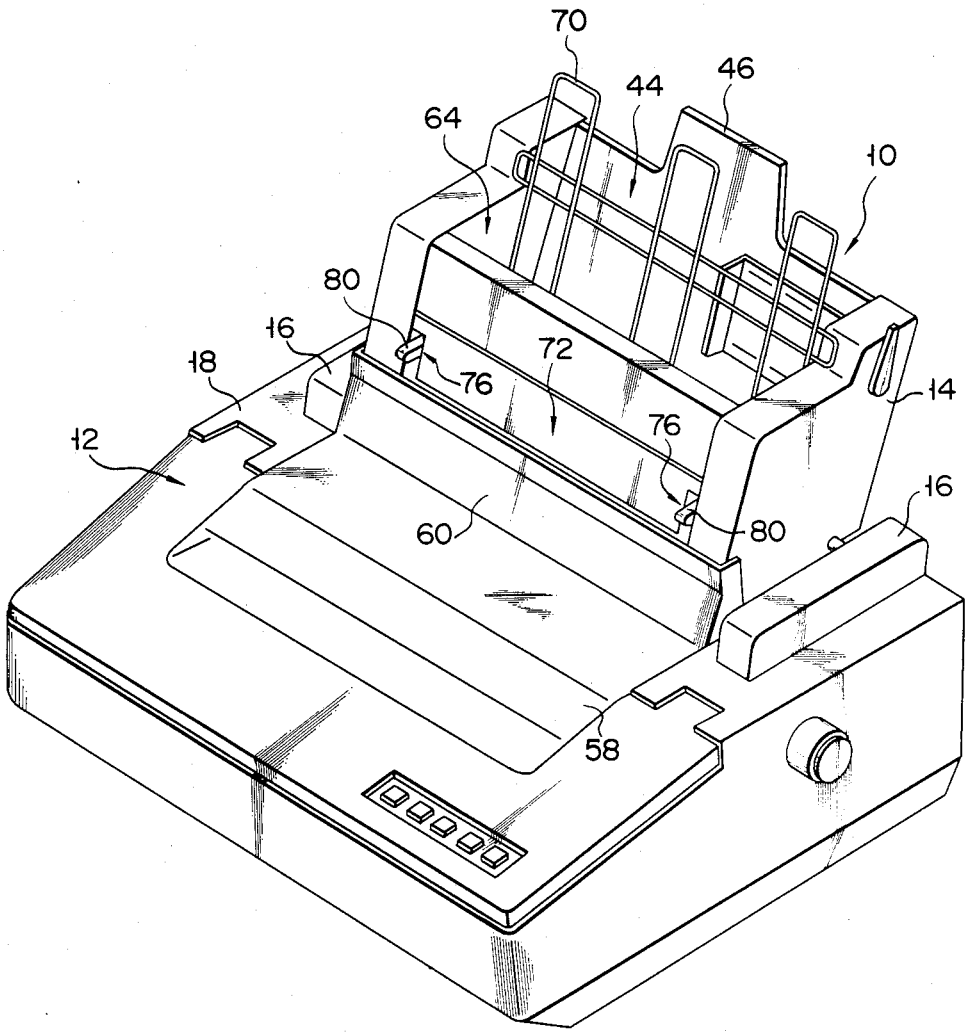
FIG. 1 is a perspective view showing an embodiment of the automatic paper sheet supplying apparatus according to the invention, wherein the supplying apparatus is combined with a paper sheet processing apparatus.

In FIG. 1, an embodiment of the automatic paper sheet supplying apparatus 10 according to the invention is combined with a paper sheet processing apparatus 12. In this embodiment, the paper sheet processing apparatus 12 is a printer connected to a computer and effects printing on (i.e., processes) the paper sheet. The paper sheet processing apparatus 12 may be a typewriter or a copier in the aspect of the invention. The automatic sheet supplying apparatus 10 according to the invention has a main body 14 and a mounting base 16 which is interposed between the paper sheet processing apparatus 12 and the main body 14. The mounting base 16 is removably provided on the top of the paper sheet processing apparatus 12. The main body 14 is removably mounted on the mounting base 16. The mounting base 16 includes power transmitting means (not shown) for transmitting power from power generating means (not shown) provided in a housing 18 of the paper sheet processing apparatus 12 to the main body 14.

FIG. 12 is a vertical sectional view schematically showing an essential part of the automatic paper sheet supplying apparatus 10 and paper sheet processing apparatus 12 shown in FIG. 1. In the Figure, the automatic paper sheet supplying apparatus 10 is shown in the automatic paper sheet supplying operation. The mounting base 16 has mounting rods 19*a* and 19*b*, on which the main body 14 is removably mounted.

A sheet passage opening 20 is formed on the housing 18 of the paper sheet processing apparatus 12. In the housing 18 are accommodated a printing head 22 as means for processing paper sheets and sheet guide means 24 for guiding a sheet introduced through the sheet passage opening 20 to the printing head 22 and also guiding a processed sheet having been processed (i.e., subjected to printing in this case) by the printing head 22 to the sheet passage opening 20.

The sheet guide means 24 includes a platen 26 provided in opposition to the printing head 22, a paper pan 28 coverng a lower half of the outer periphery of the platen 26 on the side opposite the printing head 22, pinch rollers 30 and 32 abutted against the outer periphery of the platen 26 through holes formed in the paper pan 28, and a veil roller 34 capable of being brought into contact with and separated from the outer periphery of the platen 26.

The sheet guide means 24 further includes a diverging guide member 36 provided in the neighborhood of the outer periphery of the platen 26 and having a substantially V-shaped sectional profile projecting toward the sheet passing opening 20 and a supply guide member 38 inwardly extending from the rear edge of the sheet passage opening 20 to the interior of the housing 18.

In this embodiment, a paper sheet, when it is inserted into the sheet passage opening 20 and introduced into the housing 18 along the supply guide member 38 thereof, is led between the rotating platen 26 and the paper pan 28 along a supply guide surface 40 of the diverging guide member 36. This paper sheet is abutted against the outer periphery of the platen 26 by the pinch rollers 30 and 32 and being printed by the printing head 22. The printed or processed paper sheet passes between the platen 26 and the veil roller 34 (the veil roller 34 being at this time once separated from the platen 26 to facilitate the passage of the paper sheet 42 after printing), to be led along a discharge guide surface 41 of the diverging guide member 36 toward the sheet passage opening 20.

The main body 14 of the automatic sheet supplying apparatus 10 has sheet holding means 44, which holds a plurality of paper sheets 42 and feeds them one by one. The sheet holding means 44 includes a movable plate 46, which is movable relative to the main body 14 and on which a plurality of paper sheets 42 are stacked, a compression coil spring 48 pushing the bottom of the movable plate 26 forward, a stopper member 50 disposed to be in contact with the corners of the lower edge of the uppermost paper sheet 42 in the stack on the movable plate 46 for truing up the edges of the stacked paper sheets 42, and a feed roller 52 on which the uppermost paper sheet 42 in the stack on the movable plate 46 is abutted and which moves the uppermost paper sheet 42 from the stack. The feed roller 52 is driven by power transmitted from the power generating means (not shown) provided in the housing 18 of the paper sheet processing apparatus 12 to the main body 14 through the power transmitting means (not shown).

The main body 14 of the automatic sheet supplying apparatus 10 has a first stationary guide 54 having an end portion extending into the sheet passage opening 20. The end portion noted above faces the supply guide surface 40 of the diverging guide member 36 of the paper sheet processing apparatus 12.

The rear or lower surface of the first stationary guide 54 that faces the front or upper surface of the supply guide member 38 is a first guide surface 56 which leads a paper sheet 42 having been supplied from the sheet holding means 44 toward the supply guide surface 40 of the diverging guide member 36 in co-operation with the supply guide member 38. The supply guide surface 40 introduces the paper sheet 42 into the space between the platen 26 and the paper pan 28 so that the paper sheet 42 can reach the printing head 22 for printing.

A portion of the housing 18 located above the printing head 22 and the platen 26 is constructed by a transparent cover 58. The front edge of the sheet passage opening 20 is defined by the rear edge of the transparent cover 58. At the rear edge of the transparent cover 58 a second stationary guide member 60 is formed so as to the extend along and face the front or upper surface of the first stationary guide member 54.

The loading edge of the paper sheet 42, that has been subjected to printing by the printing head 22 (i.e., processed by the paper sheet processing apparatus) and led along the discharge guide surface 41 of the diverging guide member 36, strikes the front or upper surface of the first stationary guide member 54.The front or upper surface of the first stationary guide member 54 is a second guide surface 62 which leads the processed paper sheet 42 toward the sheet passage opening 20 and then leads the processed paper sheet 42 upwards in co-operation with the second stationary guide member 60.

An exit 63, through which the processed paper sheet 42 is discharged, is provided on the extension of the second guide surface 62 of the first stationary guide member 54. In this embodiment, stacker means 64, on which processed paper sheets 42 discharged through the exit 63 are stacked, is provided at the exit 63. The stacker means 64 includes a pair of, i.e., main and auxiliary, feed-in rollers 66 and 68, which are located at the exit 63 for clamping a processed paper sheet 42 introduced into the exit 63 and supplying the processed paper sheet 42 into the interior of the stacker means 64, and a stacking member 70, on which a plurality of processed paper sheets 42 led from the main and auxiliary feed-in rollers 66 and 68 are stacked (i.e., held). The main feed-in roller 66, like the feed roller 52 noted above, is driven by power transmitted from the power generating means (not shown) provided in the housing 18 of the paper sheet processing apparatus 12 to the main body 14 through the power transmitting means (not shown) provided on the mounting base 10.

Figure 2:
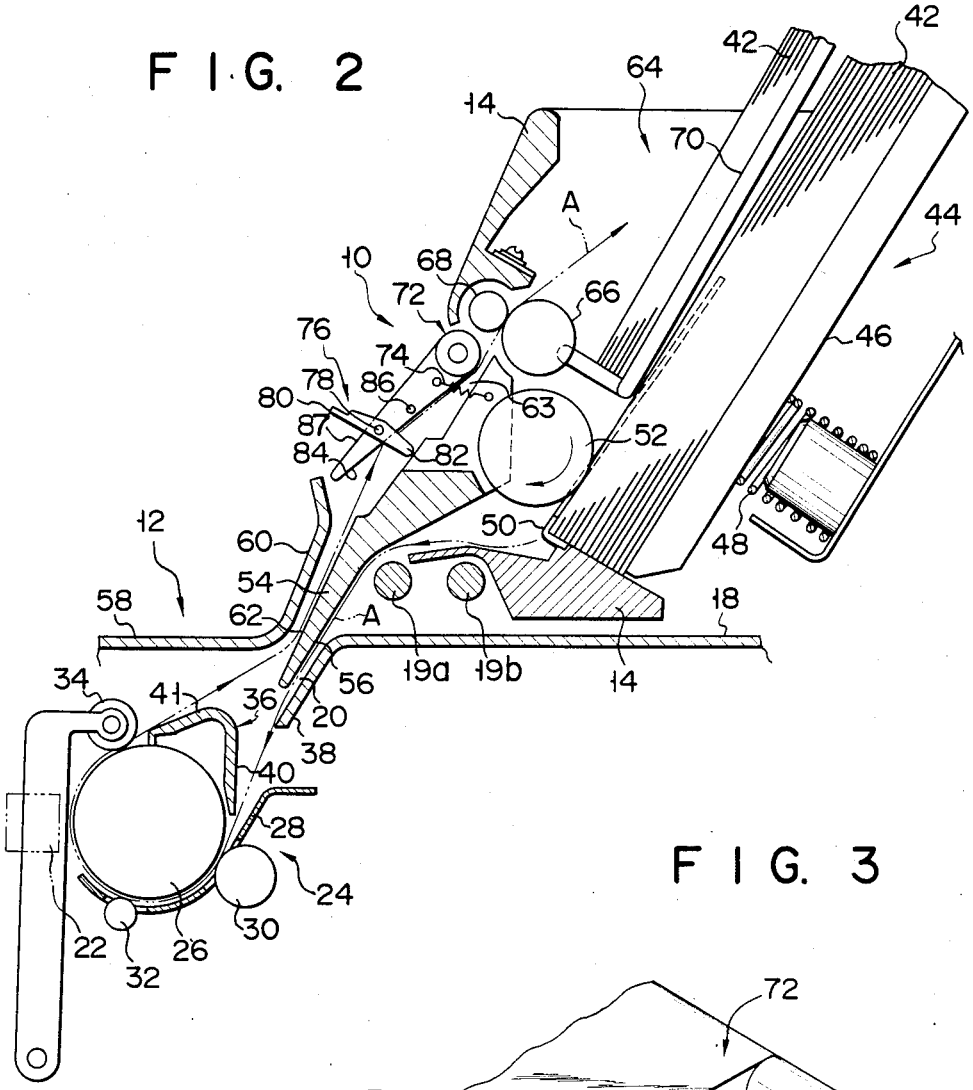
FIG. 2 is a vertical sectional view schematically showing an essential part of the automatic paper sheet supplying apparatus and paper sheet processing apparatus shown in FIG. 1, wherein an automatic paper sheet supplying operation is carried out.
Figure 4:
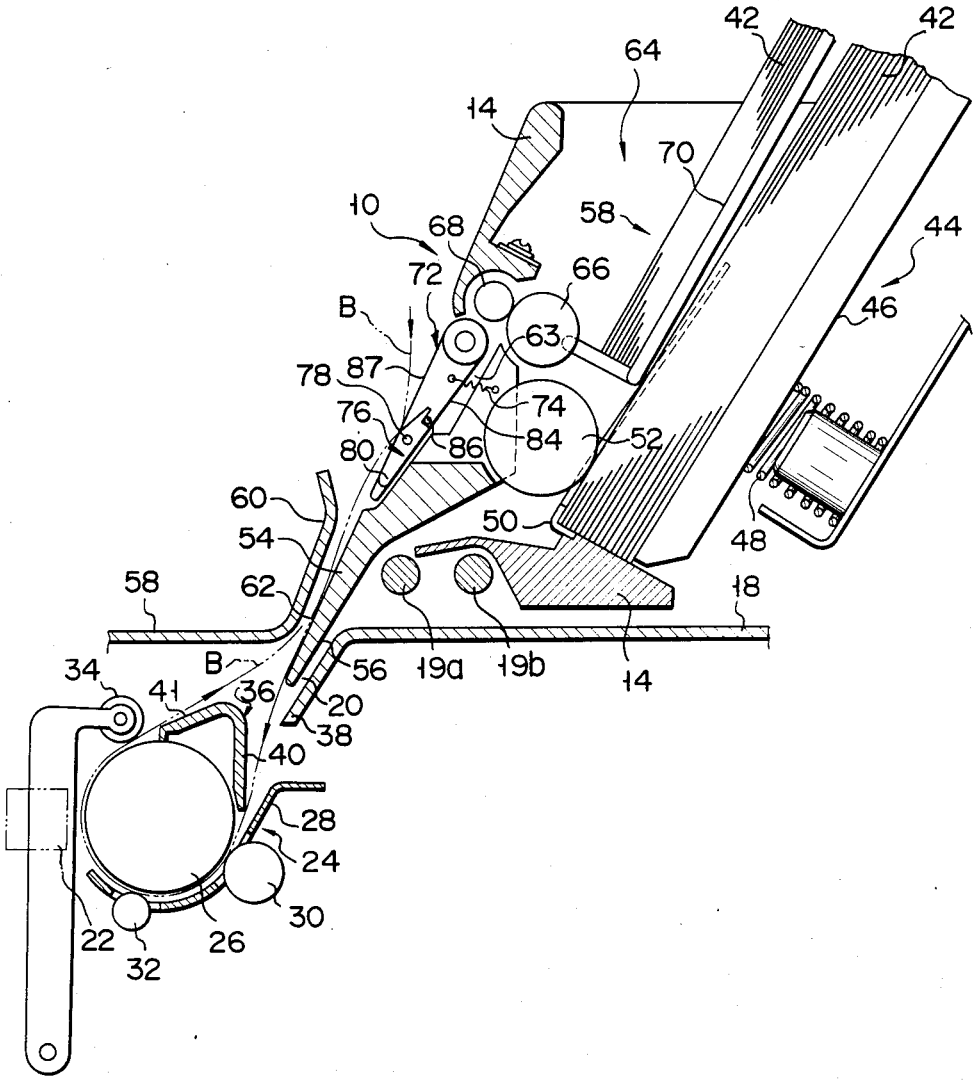
FIG. 4 is a vertical sectional view showing the structure of FIG. 3, wherein a manual paper sheet supplying operation is carried out.

On the inlet side of the exit 63 is provided a movable guide member 72, which is rotatable between a position to close the exit 63, as shown in FIG. 2, and a position to open the exit 63, as shown in FIG. 4.

The movable guide member 72 has a plate-like shape spreading out samely as the plane of the processed paper sheet 42 being guided between the second guide surface 62 of the first stationary guide member 54 and the second stationary guide member 60. The movable guide member 72 is biased to the closed position by biasing means 74.

At the both side ends of the movable guide member 72, which are located in the direction perpendicular to the direction of progress of the processed paper sheet 42 moving between the second guide surface 62 of the first stationary guide member 54 and the second stationary guide member 60, switch operation means 76 is provided for bringing the movable guide member 72 to the open position as shown in FIG. 2 against the biasing force of the biasing means 74.

In this embodiment, the switch operation means 76 includes a pair of elongated members 80 secured to the opposite ends of a shaft 78, which penetrates the movable guide member 72 in the longitudinal direction thereof and rotatable with respect thereto. The pair elongated members 80 are rotatable in an imaginary plane which intersects the plane (i.e., top and botton surfaces) of the movable guide member 72. When the elongated members 80 are arranged to intersect the plane of the movable guide member 72 as shown in FIGS. 1 and 2, one end 82 of each elongated member 80 is in contact with the boundary of the exit 63 opposite the rear surface of the movable guide member 72 to hold the movable guide member 72 in the open position against the biasing force of the biasing means 74. The position of the elongated members 80 at this state is referred to as their first position. When the movable guide member 72 is at the open position, it is located on the extension of the second stationary guide.

The processed paper sheet 42 moving, between the second guide surface 62 of the first stationary guide member 54 and second stationary guide member 60, from the sheet passage opening 20 strikes at its leading edge against the rear or lower surface 84 of the movable guide member 72 to be led into the exit 63 and then be clamped by the main and auxiliary feed-in rollers 66 and 68 of the stacker means 64 so that it is moved to be stacked on the stacking member 70.

In FIG. 2, the automatic sheet supplying apparatus 10 is shown in its automatic sheet supplying operation. In the Figure, the locus, on which a paper sheet 42 moves from the sheet holding means 44 to the stacker means 64 via the printing head 22 as paper processing means, is shown by a two-dot chain line A.

The distance between the one ends 82 of the pair of elongated members 80 is so set as to restrict the movement of the processed paper sheet 42 in the directions substantially perpendicular to the direction of the movement of the sheet 42 between the second guide surface 62 of the first stationary guide member 54 and the second stationary guide member 60 (i.e., directions perpendicular to the plane of the sheet in FIG. 2) in order to ensure the holding or stacking the processed paper sheet 42 in the stacker means 64.

When switching the automatic sheet supplying operation shown in FIG. 2 over to the manual sheet supplying operation, the elongated members 80 of the swith operation means 76 are turned to a parallel position, at which they extend substantially parallel to the plane of the movable guide member 72 and their one ends 82 is spaced apart from the circumferential area of the exit 63. In this state, the movable guide member 72 is held in its closed position as shown in FIG. 4 by the biasing force of the biasing means 74.

Figure 3:
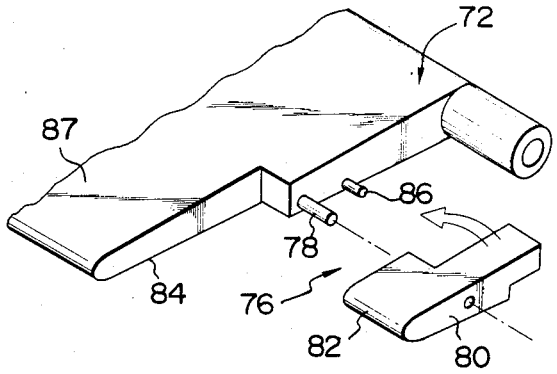
FIG. 3 is an enlarged-scale exploded perspective view showing a movable guide member and an elongated member mounted thereon so as to act as switch operation means shown in FIG. 2.

When the elongated members 80 are brought to be substantially parallel to the plane of the movable guide member 72, they engage with fixed pins 86 projecting from the opposite side ends of the movable guide member 72 as shown in FIG. 3, whereby they are held or stand still in the parallel position noted above. The position of the elongated members 80 at this time is referred to as their second position.

When the movable guide member 72 is in the closed position, the movable guide member 72 is located on the extension of the second guide surface 62, as shown in FIG. 4. Particularly, the front or upper surface 87 of the movable guide member 72 is flush with the second guide surface 62 and does not form any step with respect to the second guide surface 62.

When the movable guide member 72 is in its closed position, the passage defined between the second guide surface 62 of the first stationary guide member 54 and the second stationary guide member 60 is open to an outer space, as shown in FIG. 4.

Through this opening, a paper sheet can be manually inserted into the passage noted above. The inserted paper sheet is guided along the front or upper surface 87 of the movable guide member 72 and the second guide surface 62 of the first stationary guide member 54 to reach the sheet passage opening 20, as shown by two-dot chain line B in FIG. 4. Since the end of the first stationary guide member 54 faces the supply guide surface 40 of the diverging guide member 36 of the paper sheet processing apparatus 12, the leading edge of the paper sheet guided along the second guide surface 62 strikes the supply guide surface 40, so that the paper sheet can move into the space between the platen 26 and the paper pan 28 to be printed by the printing head 22. After the printing is done, the processed or printed paper sheet is guided along the discharge guide surface 41 of the diverging guide member 36 toward the second guide surface 62 of the first stationary guide member 54, and then the processed paper sheet is guided along the second guide surface 62 and the front or upper surface 87 of the movable guide member 72 to be discharged from the space between the second guide surface 62 and second stationary guide member 60 to the outer space. Since the front surface 87 of the movable guide member 72 is flush the second guide surface 62 of the first stationary guide member 54 without making any step therebetween, the paper sheet 42 can move along the front or upper surface 87 and second guide surface 62 without the possibility of jamming.

Figure 5:
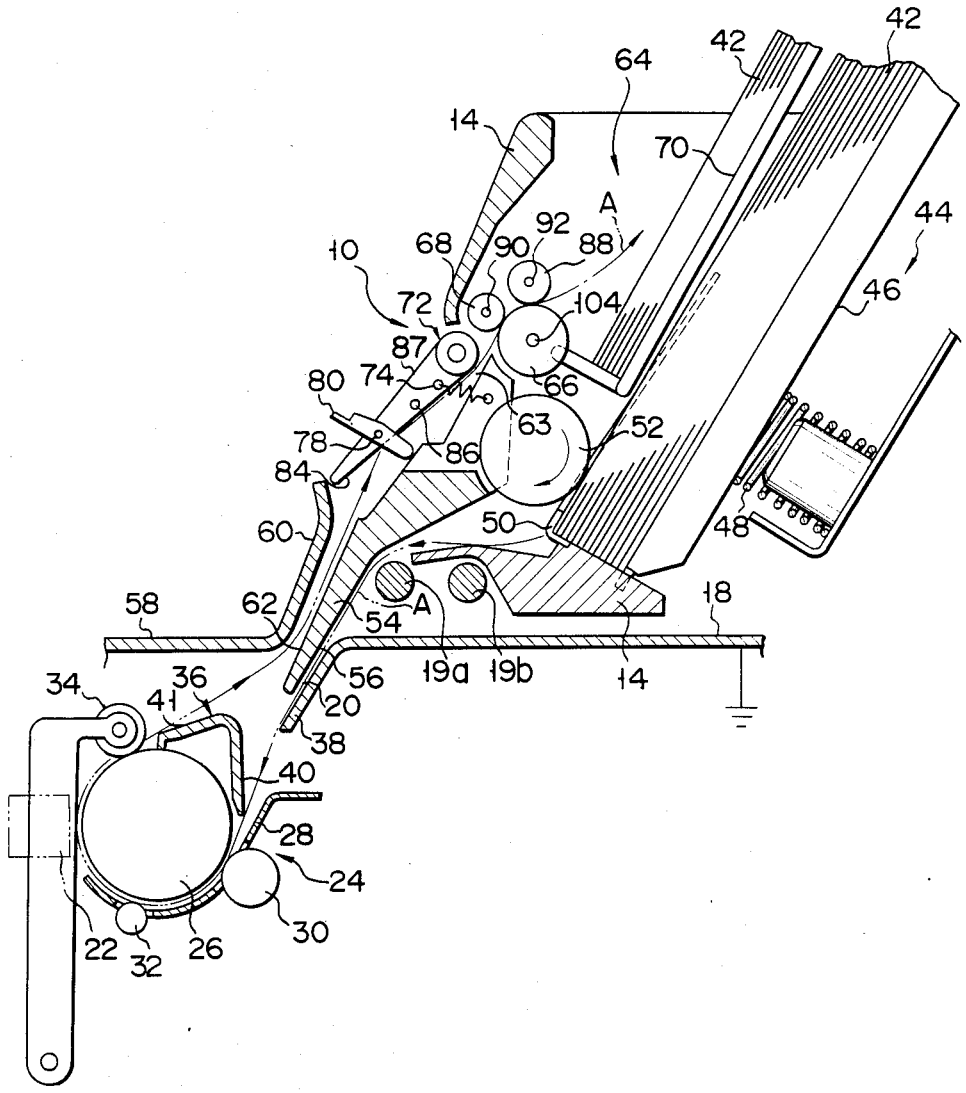
FIG. 5 is a vertical sectional view similar to FIG. 2 but showing a modification of the embodiment of the automatic paper sheet supplying apparatus, wherein an automatic paper sheet supplying operation is carried out.
Figure 6:
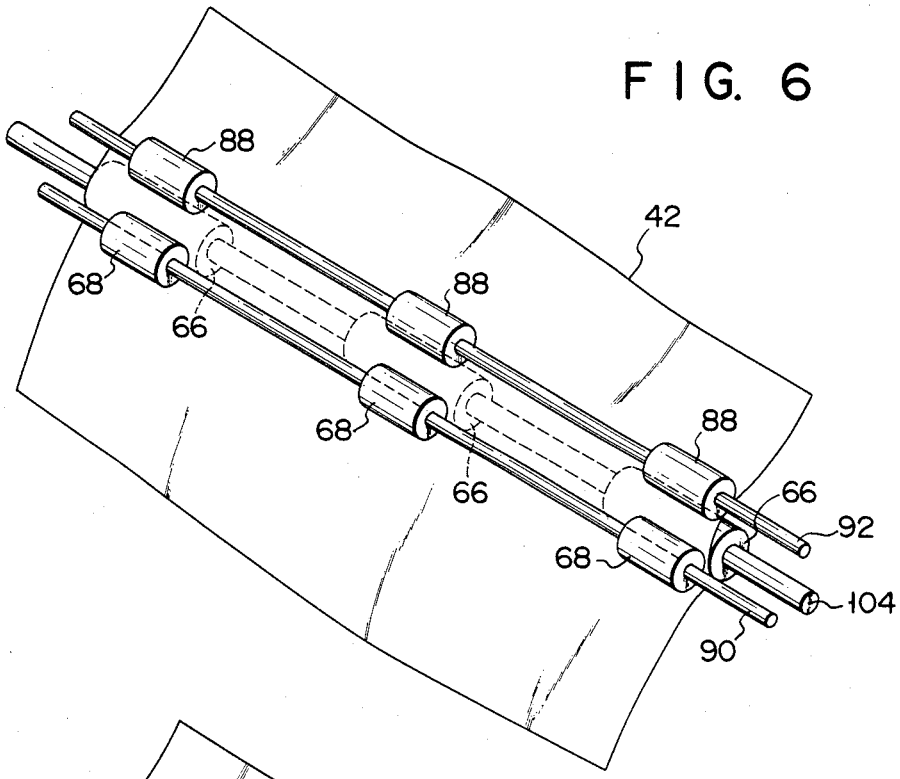
FIG. 6 is an enlarged-scale perspective view showing a main feed-in roller and a pair of auxiliary feed-in rollers of stacker means shown in FIG. 5.

FIGS. 5 and 6 illustrate a modification of the embodiment of the automatic sheet supplying apparatus according to the invention. In the Figures, parts like those of the preceding embodiment shown in FIGS. 1 to 4 are designated by the same reference numerals, and their detailed description is omitted.

In this modification, another auxiliary feed-in roller 88 is provided at a position spaced apart from the first auxiliary feed-in roller 68 along the outer periphery of the main feed-in roller 66 of the stacker means 64. The another auxiliary feed-in roller 88 is also urged against the outer periphery of the main feed-in roller 66. In this modification, the two auxiliary feed-in rollers 68 and 88 are spaced apart a distance corresponding to an angle of about 60° with respect to the axis of the main feed-in roller 66. These auxiliary feed-in rollers 68 and 88 are spaced apart a distance corresponding to an angle of about 60° with respect to the axis of the main feed-roller 66. These auxiliary feed-rollers 68 and 88 are made of conductive rubber and are secured to respective shafts 90 and 92 which are made of a conductive material. These shafts 90 and 92 are in turn rotatably mounted in the main body 14 of the automatic paper sheet supplying apparatus 10.

The processed paper sheets 42 coming from the exit 63 are clamped by the main feed-in roller 66 and each of the two auxiliary feed-in rollers 68 and 88. Thus, they can be reliably led into the stacker means 64 without any slip and at a constant speed so that they can be stacked on the front or upper surface of the stacking member 70 without making irregularity. If the processed paper sheet 42 coming from the exit 63 bear static electricity produced by friction until the processed paper sheet 42 reaches the exit 63, such static electricity is grounded through the two auxiliary feed-in rollers 68 and 88, main body 14 and paper sheet processing apparatus 12. Thus, there is no possibility for a plurality of processed paper sheets 42 to be stacked irregularly on the stacking member 70 of the stacker means 64 due to static electricity.

Figure 8:
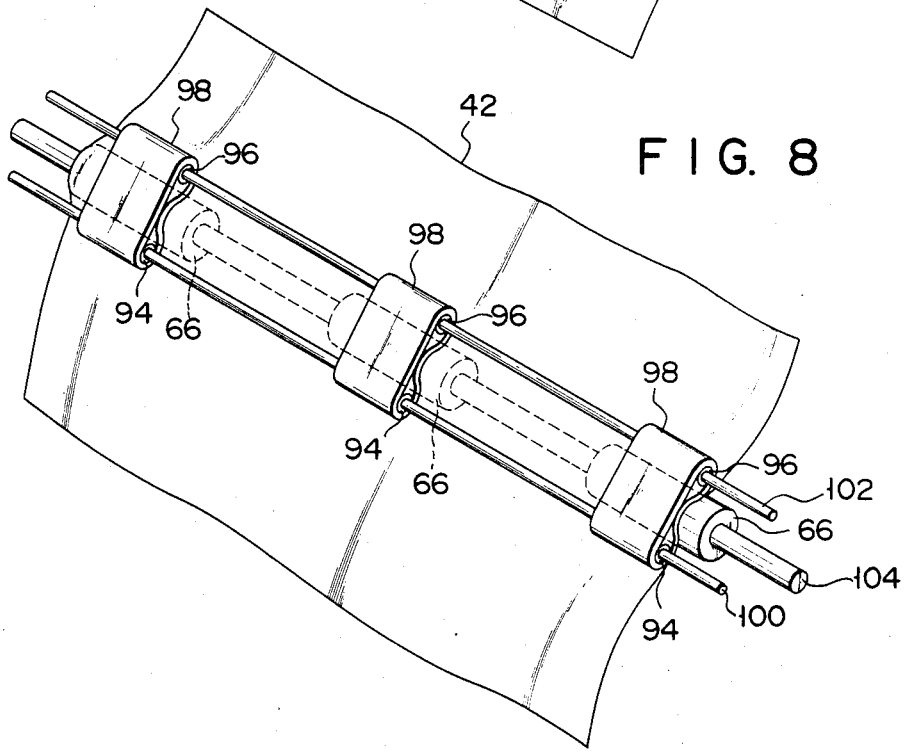
FIG. 8 is an enlarged-scale perspective view showing a main feed-in roller, a pair of auxiliary feed-in rollers and an endless belt of stacker means shown in FIG. 7.
Figure 7:
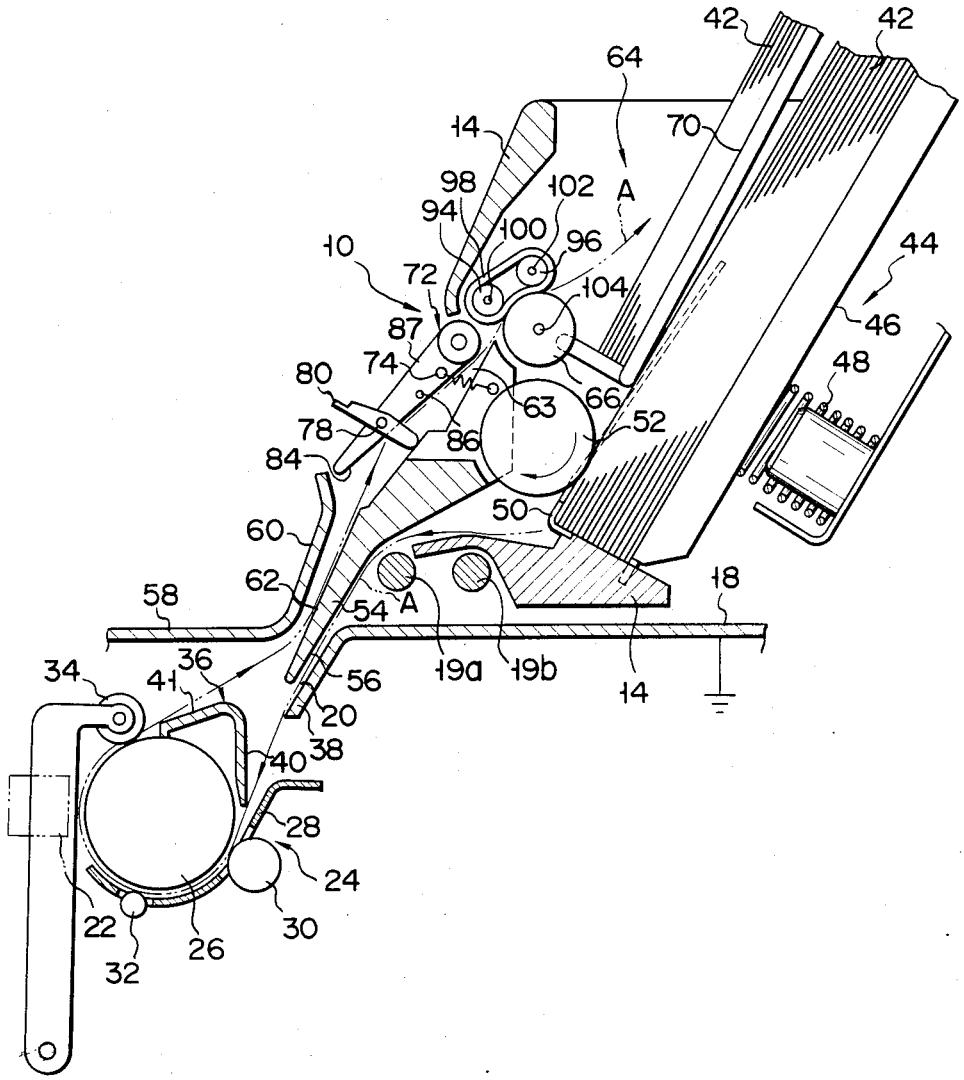
FIG. 7 is a sectional view similar to FIG. 2 but showing a further modification of the embodiment of the automatic paper sheet supplying apparatus, wherein an automatic paper sheet supplying operation is carried out.

FIGS. 7 and 8 illustrate another modification of the automatic paper sheet supplying apparatus according to the invention. Again in these Figures, parts like those in the previous embodiment shown in FIGS. 1 to 4 are designated by the same reference numerals, and their detailed description is omitted.

In this modification, a pair of auxiliary feed-in rollers 94 and 96 are provided in the neighborhood of the outer periphery of the main feed-in roller 66 of the stacker means 64 such that they are spaced apart along the outer periphery of the main feed-in roller 66. An endless belt 98 is passed round the pair of auxiliary feed-in rollers 94 and 96 such that it is in contact with the outer periphery of the main feed-in roller 66 between the pair of auxiliary feed-in rollers 94 and 96. In this modification, the two auxiliary feed-in rollers 94 and 96 and endless belt 98 are made of conductive rubber. The two auxiliary feed-in rollers 94 and 96 are secured to conductive shafts 100 and 102 which are rotatably mounted on the main body 14 of the automatic sheet supplying apparatus 10.

Again in this modification, processed paper sheets 42 coming from the exit 63 are clamped between the main feed-in roller 66 and the endless belt 98. Thus, they can be reliably led into the stacker means 64 without any slip and at a constant speed so that they can be stacked on the front or upper surface of the stacking member 70 without making irregularity. In addition, due to friction if static electricity is produced on the processed paper sheet 42 coming from the exit 63 until it reaches the exit 63, the static electricity is grounded through the endless belt 98, two auxiliary feed-in rollers 94 and 96, shafts 100 and 102, main body 14 and paper sheet processing apparatus 12, thus eliminating the possibility of a plurality of processed paper sheets 42 to be stacked irregularly on the stacking member 70 of the stacker means 64 due to static electricity.

The main feed-in roller 66 in the above two modifications of the embodiment of the invention, illustrated in FIGS. 5 to 8, may be made of conductive rubber so that static electricity produced on the processed paper sheet 42 may be grounded through the main feed-in roller 66, shaft 104 which is made of a conductive material, supports the main feed-in roller 66, and is rotatably supported on the main body 14, and paper sheet processing apparatus 12.

What is claimed is:

1. An automatic paper sheet supplying apparatus to be used in combination with a paper sheet processing apparatus having a sheet passage opening provided in a housing, paper sheet processing means for processing paper sheets and paper sheet guide means for guiding a paper sheet coming from said sheet passage opening and also guiding a processed paper sheet coming from said paper sheet processing means to said sheet passage opening, comprising:

sheet holding means for holding a plurality of paper sheets and feeding out said plurality of paper sheets one after another;

a first stationary guide member with an end portion extending into said sheet passage opening of said paper sheet processing apparatus, said first stationary guide member having a first guide surface for guiding a paper sheet coming from said holding means to said sheet guide means of said paper sheet processing apparatus and a second guide surface for guiding a processed paper sheet from said paper sheet guide means through said sheet passage opening to be discharged to the outside of said paper sheet processing apparatus and for also guiding a paper sheet, which is separate from the plurality of paper sheets held in said sheet holding means and is inserted into said sheet passage opening from the outside of said paper sheet processing apparatus to said sheet guide means to let the separate paper sheet be guided by said sheet guide means to said paper sheet processing means;

a second stationary guide member spaced from and facing said second guide surface of said first stationary guide member so as to define a passage between said second stationary guide member and said second guide surface of said first stationary guide member, said second stationary guide member guiding, in co-operation with said second guide surface of said first stationary guide member, a processed paper sheet discharged from said sheet passage opening and guiding said separate paper sheet inserted into said sheet passage opening;

an exit provided on an extension of said second guide surface of said first stationary guide member and discharging a processed paper sheet to the outside of said paper sheet processing apparatus;

a movable guide member provided adjacent to the inlet side of said exit and movable between an open position, at which said exit is open, and a closed position, at which said exit is closed, said movable guide member, when it is in said open position, being located on an extension of said second stationary guide member to guide a processed paper sheet discharged through said sheet passage opening and coming through said passage defined between said second guide surface of said first stationary guide member and said second stationary guide member to said exit; said movable guide member, when it is in said closed position, being located on the extension of said second guide surface of said first stationary guide member to guide said processed paper sheet coming through said passage defined between said second guide surface of said first stationary guide member and said second stationary guide member to the outside of said paper sheet processing apparatus and also guide said separate paper sheet from the outside into the space between said second guide surface of said first stationary guide member and said second stationary guide member; and switch operation means for switching said movable guide member between said open position and closed position.

2. The automatic paper sheet supplying apparatus according to claim 1, wherein said movable guide member extends flush with said second guide surface of said first stationary guide member without making any step therebetween when in said closed position.

3. The automatic paper sheet supplying apparatus according to claim 2, wherein said movable guide member has a plate-like shape spreading out substantially in the plane of a paper sheet moving between said second stationary guide member and said second guide surface of said first stationary guide member; and said switch operation means includes an elongated member provided at least at either side end of said movable guide member in a direction thereof perpendicular to the direction of progress of paper sheet, said elongated member being rotated in an imaginary plane which intersects the plane of said movable guide member between a first position, at which said elongated member crosses the plane of said movable guide member and one end thereof is in contact with the boundary of said exit opposite the surface of the movable guide member facing said exit to hold said movable guide member in said open position, and a second position, at which said elongated member extends substantially parallel to the plane of said movable guide member and one end thereof is spaced apart from said circumferential area of said exit to allow the location of said movable guide member in said closed position.

4. The automatic paper sheet supplying apparatus according to claim 3, wherein said switch operation means includes biasing means for biasing said movable guide member to said closed position.

5. The automatic paper sheet supplying apparatus according to claim 3, wherein said switch operation means includes another elongated member provided at the end of the other side of said movable guide member, the distance between one end of each of said two elongated members being set so as to restrict the movement of a processed paper sheet, that comes from said sheet passage opening between said second guide surface of said first stationary guide member and said second stationary guide member in order that said processed sheet be discharged to the outside through said exit, in directions substantially perpendicular to the direction of progress of said processed paper sheet.

6. The automatic paper sheet supplying apparatus according to claim 5, wherein said switch operation means includes biasing means for biasing said movable guide member to said closed position.

7. The automatic paper sheet supplying apparatus according to claim 1, wherein said movable guide member has a plate-like shape spreading out substantially in the plane of a paper sheet moving between said second stationary guide member and said second guide surface of said first stationary guide member; and said switch operation means includes an elongated member provided at least at either side end of said movable guide member in a direction thereof perpendicular to the direction of progress of the paper sheet, said elongated member being rotatable in an imaginary plane which interesects the plane of said movable guide member between a first position, at which said elongated member crosses the plane of said movable guide member and one end thereof is in contact with the boundary of said exit opposite the surface of the movable guide member facing said exit to hold said movable guide member in said open position, and a second position, at which said elongated member extends substantially parallel to the plane of said movable guide member and one end thereof is spaced apart from said circumferential area of said exit to allow the location of said movable guide member in said closed position.

8. The automatic paper sheet supplying apparatus according to claim 7, wherein said switch operation means includes biasing means for biasing said movable guide member to said closed position.

9. The automatic paper sheet supplying apparatus according to claim 8, wherein said switch operation means includes another elongated member provided at the other side end of said movable guide member, the distance between one end of each of said two elongated members being set so as to restrict the movement of a processed paper sheet, that comes from said sheet passage opening between said second guide surface of said first stationary guide member and said second stationary guide member in order that said processed sheet be discharged to the outside through said exit, in directions substantially perpendicular to the direction of progress of said processed paper sheet.

10. The automatic paper sheet supplying apparatus according to claim 9, wherein said switch operation means includes biasing means for biasing said movable guide member to said closed position.

11. The automatic paper sheet supplying apparatus according to claim 1, which further comprises stacker means for holding a plurality of processed paper sheets, coming from said exit, in the form of a stack.

12. The automatic paper sheet supplying apparatus according to claim 11, wherein said stacker means includes a main feed-in roller provided at said exit and a plurality of auxiliary feed-in rollers spaced apart along and in contact with the outer periphery of said main feed-in roller so as to clamp, in co-operation with said main feed-in roller, a processed paper sheet having been led to said exit by said movable guide member and move it into said stacker means.

13. The automatic paper sheet supplying apparatus according to claim 12, wherein at least one of said main feed-in roller and said plurality of feed-in rollers are made of a conductive material and grounded for removing static electricity from a processed paper sheet clamped between said main feed-in roller and plurality of auxiliary feed-in rollers.

14. The automatic paper sheet supplying apparatus according to claim 11, wherein said stacker means includes a main feed-in roller provided at said exit, a pair of auxiliary feed-in rollers disposed in the neighborhood of the outer periphery of said main feed-in roller and spaced apart along the outer periphery of said main feed-in roller, and an endless belt passed round said pair of auxiliary feed-in rollers and in contact with the outer periphery of said main feed-in roller between said pair of auxiliary feed-in rollers to clamp, in co-operation with said main feed-in roller, a processed paper sheet having been led to said exit by said movable guide member and move it into said stacker means.

15. The automatic paper sheet supplying apparatus according to claim 14, wherein at least one of main feed-in roller and endless belt is made of a conductive material and is grounded so that static electricity is removed from a processed paper sheet clamped between said main feed-in roller and endless belt.

* * * * *